US012504252B2

(12) United States Patent
Liu

(10) Patent No.: US 12,504,252 B2
(45) Date of Patent: Dec. 23, 2025

(54) RAPID REPEATING DEVICE

(71) Applicant: Chi-Chang Liu, Taichung (TW)

(72) Inventor: Chi-Chang Liu, Taichung (TW)

(73) Assignee: POE LANG ENTERPRISE CO., LTD.

( * ) Notice: Subject to any disclaimer, the term of this patent is extended or adjusted under 35 U.S.C. 154(b) by 157 days.

(21) Appl. No.: 18/508,252

(22) Filed: Nov. 14, 2023

(65) Prior Publication Data

US 2025/0155219 A1 May 15, 2025

(51) Int. Cl.
*F41B 5/12* (2006.01)

(52) U.S. Cl.
CPC ..... *F41B 5/126* (2013.01)

(58) Field of Classification Search
CPC ..... F41B 5/126; F41B 5/12; F41B 5/1469; F41B 5/123
USPC ..... 124/25, 25.5, 31
See application file for complete search history.

(56) References Cited

U.S. PATENT DOCUMENTS 2,516,341 A * 7/1950 Raffeis ..... F41B 5/12 124/35.1
4,827,894 A * 5/1989 Schallberger ..... F41B 5/12 124/25
5,085,200 A * 2/1992 Horton-Corcoran ..... F41B 5/1469 124/40
9,435,605 B2 * 9/2016 McPherson ..... F41B 5/12
10,378,853 B1 * 8/2019 Liu ..... F41B 5/1469
10,408,561 B1 * 9/2019 Liu ..... F41B 5/1469
10,663,249 B1 * 5/2020 Liu ..... F41B 5/126
11,359,882 B1 * 6/2022 Chang ..... F41B 5/14
11,892,265 B1 * 2/2024 Chu ..... F41B 5/1469
2015/0233666 A1 * 8/2015 Rodich ..... F41B 5/126 124/52
2022/0026171 A1 * 1/2022 Liu ..... F41B 5/126
2022/0049921 A1 * 2/2022 Liu ..... F41B 5/126

* cited by examiner

*Primary Examiner* — John E Simms, Jr.

(57) ABSTRACT

A rapid repeating device is provided. The rapid repeating device includes a main body including an arrow portion, a shooting portion with a bowstring component, and a trigger portion with a trigger unit. A control component is disposed in the arrow portion and partially located inside the main body and partially exposed outside the arrow portion. When the control component moves toward the shooting portion, the control component is away from the trigger unit, and when the control component moves away from the shooting portion, the control component movably abuts against the trigger unit. An arrow box is disposed on the top of the main body, and a plurality of arrows are disposed in the arrow box and one by one fall into the control component that is partially exposed outside the arrow portion.

10 Claims, 15 Drawing Sheets

RAPID REPEATING DEVICE

FIELD OF THE DISCLOSURE

The present disclosure is related to a rapid repeating device, in particular the technology used in the field of shooting.

BACKGROUND OF THE DISCLOSURE

In the conventional arts, the bows require extra steps to continuously shoot, for example, a folding bow that can be loaded by pulling as disclosed in TW I591314, entitled "Bow of the bowed string device," or a bow that can be loaded through the rotating mechanism, as disclosed in TW M641344, entitled "crossbow string structure." In addition to the extra time spent on the operation, the most obvious problem is the step of pulling the trigger.

In TW I591314, the user must pull the trigger finger away from the trigger and perform a pivoting operation for every loading. In TW M641344, the user also needs to pull the trigger finger away from the trigger to operate the reel. These bow designs are most likely to interrupt the user's shooting accuracy. In addition, there are some types of bows that the trigger will move during operation. If the user pulls the finger away too late, the finger will be caught between the trigger and the trigger guard and cause injury.

Therefore, relevant industries are trying to provide a method or a device to solve the above problems.

SUMMARY OF THE DISCLOSURE

The present disclosure provides a rapid repeating device with the convenience of continuous shooting operation without removing the finger from the trigger when using a folding bow. This not only shortens the operation time, but also protects the safety of the fingers. Moreover, the device also maintains shooting accuracy and stability, improving the deficiencies and problems described in the conventional technology.

The present provides a rapid repeating device, includes: a main body, having an arrow portion on the top, a shooting portion equipped with a bowstring component, and a trigger portion at the bottom and provided with a trigger unit; a control component, disposed on the arrow portion of the main body, and partially located inside the main body and partially exposed outside the arrow portion; wherein when the control component moves toward the shooting portion, the control component is away from the trigger unit, and when the control component moves away from the shooting portion, the control component movably abuts against the trigger unit; an arrow box, disposed on the top of the main body; wherein a plurality of arrows are disposed in the arrow box and one by one fall into the control component that partially exposed outside the arrow portion; and a control handle unit, having one end pivotally disposed on the main body and located below the arrow portion; wherein, the control handle unit is pivotally assembled with the control component; wherein a loading mode is formed when the control handle unit is pivoted relative to the main body and moves the control component toward the shooting portion; wherein a shooting mode is formed when the control handle unit is pivoted to the direction opposite to the shooting portion and moves the control component back; wherein through each pivot movement of the control handle unit, the displacement of the control component on the arrow portion is controlled; wherein during the loading mode, the control component does not abut against the trigger unit, and the trigger unit retains the trigger portion; wherein during the shooting mode, the control component moves in the direction opposite to the shooting portion, the control component abuts against the trigger unit, so that it allows the pulling of the trigger unit to drive the control component and release the bowstring component to release the plurality of arrows one by one.

BRIEF DESCRIPTION OF THE DRAWINGS

The described embodiments may be better understood by reference to the following description and the accompanying drawings in which.

DETAILED DESCRIPTION OF THE EXEMPLARY EMBODIMENTS

Figure 1:
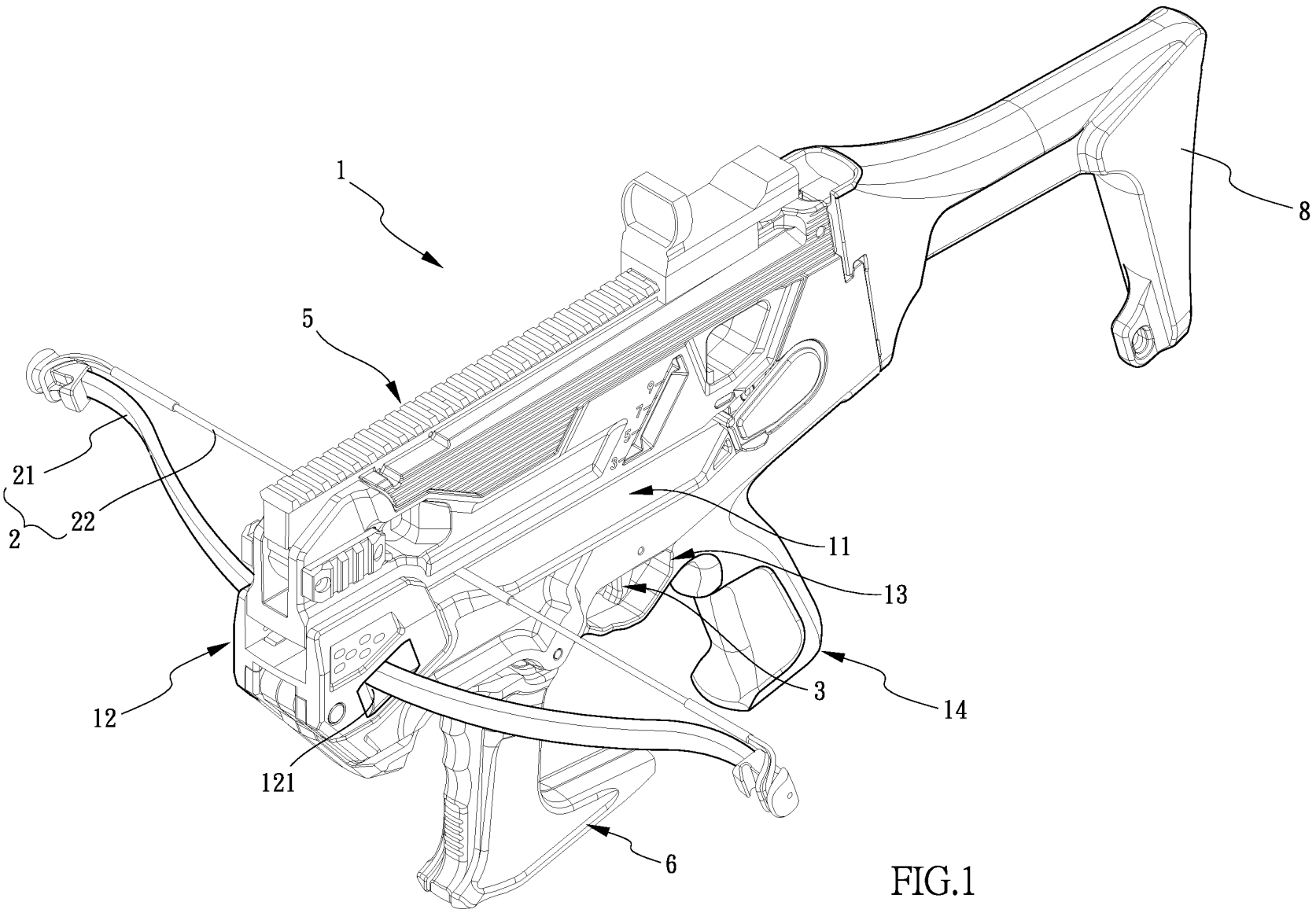
FIG. 1 is a perspective schematic view of one embodiment of the present disclosure.
Figure 2:
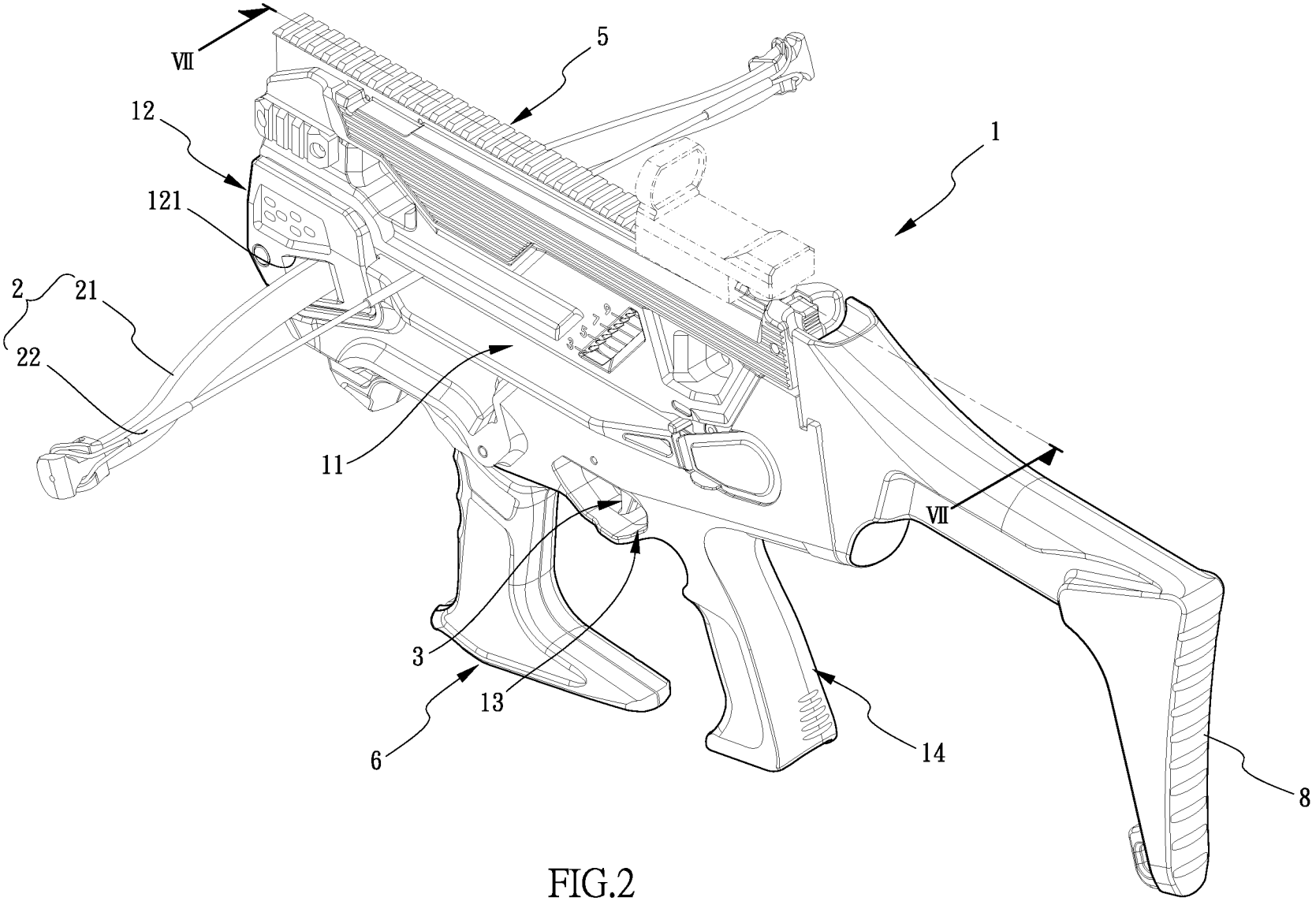
FIG. 2 is another schematic perspective view of another angel of the present disclosure.
Figure 3:
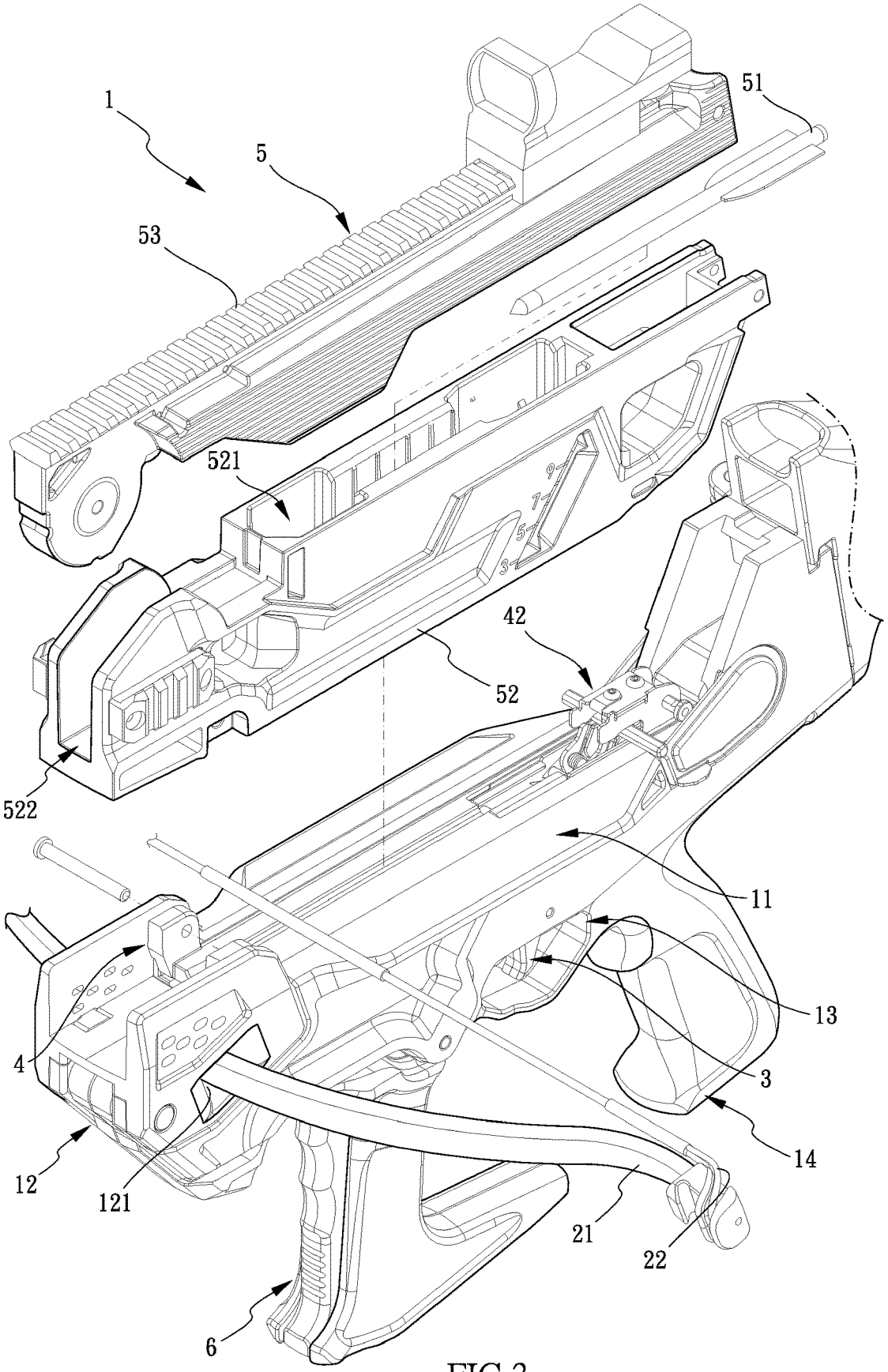
FIG. 3 is an exploded perspective schematic view of the main body and the arrow box of the present disclosure.

Referring to FIGS. 1-13, the present provides a rapid repeating device, including a main body 1, a control component 4, an arrow box 5, and a control handle unit 6. The main body 1 has an arrow portion 11 on the top, a shooting portion 12 equipped with a bowstring component 2, a trigger portion 13 at the bottom, and a grip portion 14 for the user to hold, and the trigger portion 13 has a trigger unit 3. The control component 4 is disposed on the arrow portion 11 of the main body 1, and partially located inside the main body 1 and partially exposed outside the arrow portion 11. Further, when the control component 4 moves toward the shooting portion 12, the control component 4 is away from the trigger unit 3 and hooks the bowstring component 2. When the control component 4 moves away from the shooting portion 12, the control component 4 movably abuts against the trigger unit 3. The arrow box 5 is disposed on the top of the main body 1. A plurality of arrows 51 are disposed in the arrow box 5 and one by one fall into the control component 4 that partially exposed outside the arrow portion 11. The control handle unit 6 has one end pivotally disposed on the main body 1 and located below the arrow portion 11. The control handle unit 6 pivots relative to the main body 1 with the above-mentioned pivot point as the center. The control handle unit 6 is pivotally assembled with the control component 4. A loading mode is formed when the control handle unit 6 is pivoted relative to the main body 1 and moves the control component 4 toward the shooting portion 12. A shooting mode is formed when the control handle unit 6 pivots to the direction opposite to the shooting portion 12 and moves the control component 4 reset. In detail, through each pivot movement of the control handle unit 6, the displacement of the control component 4 on the arrow portion 11 is controlled. During the loading mode, the control component 4 does not abut against the trigger unit 3 (the control component 4 is away from the trigger unit 3), and the trigger unit 3 retains the trigger portion 13. During the shooting mode, the control component 4 moves in the direction opposite to the shooting portion 12, and the control component 4 abuts against the trigger unit 3, so that it allows the pulling of the trigger unit 3 to drive the control component 4 and release the bowstring component 2 to release the plurality of arrows 51 one by one.

According to the above description, after the user holds the grip portion 14 with one hand, the other hand holds the control handle unit 6 to move forward and backward. The position of the control handle unit 6 leads the control component 4 to move forward and backward on the arrow portion 11. When the control handle unit 6 moves forward, the control component 4 is driven to move toward the shooting portion 12, and the control component 4 is buckled after moving to the position of the bowstring component 2, and then control the control handle unit 6 to move in the opposite direction as mentioned above. At this time, the control component 4 will be pulled and return along the original path. During the movement of the control component 4, the bowstring component 2 will be pulled to stretch and tighten until the control handle unit 6 returns to its original position and is positioned. Then the arrow 51 falls on the control component 4 of the arrow portion 11. Meanwhile, the bowstring component 2 which is tightened by the control component 4 is at the arrow nock of the arrow 51. By pressing the trigger unit 3, the bowstring component 2 can be released through the cooperation between the trigger unit 3 and the control component 4. In this way, the bowstring component 2 can release the arrow 51 without any deviation, thereby maintaining stability and accuracy.

Figure 4:
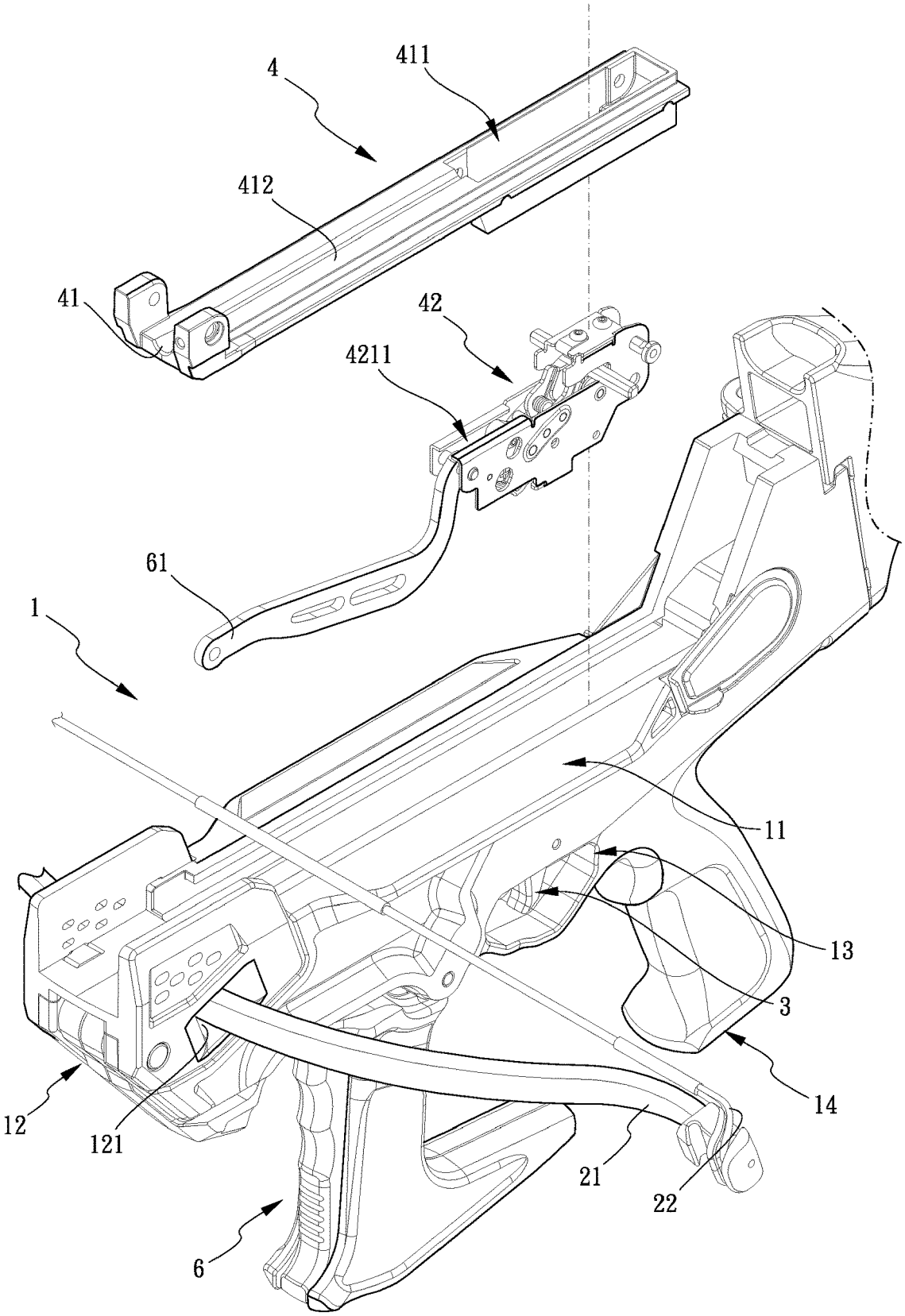
FIG. 4 is an exploded perspective schematic view of the main body and the control component of the present disclosure.
Figure 5:
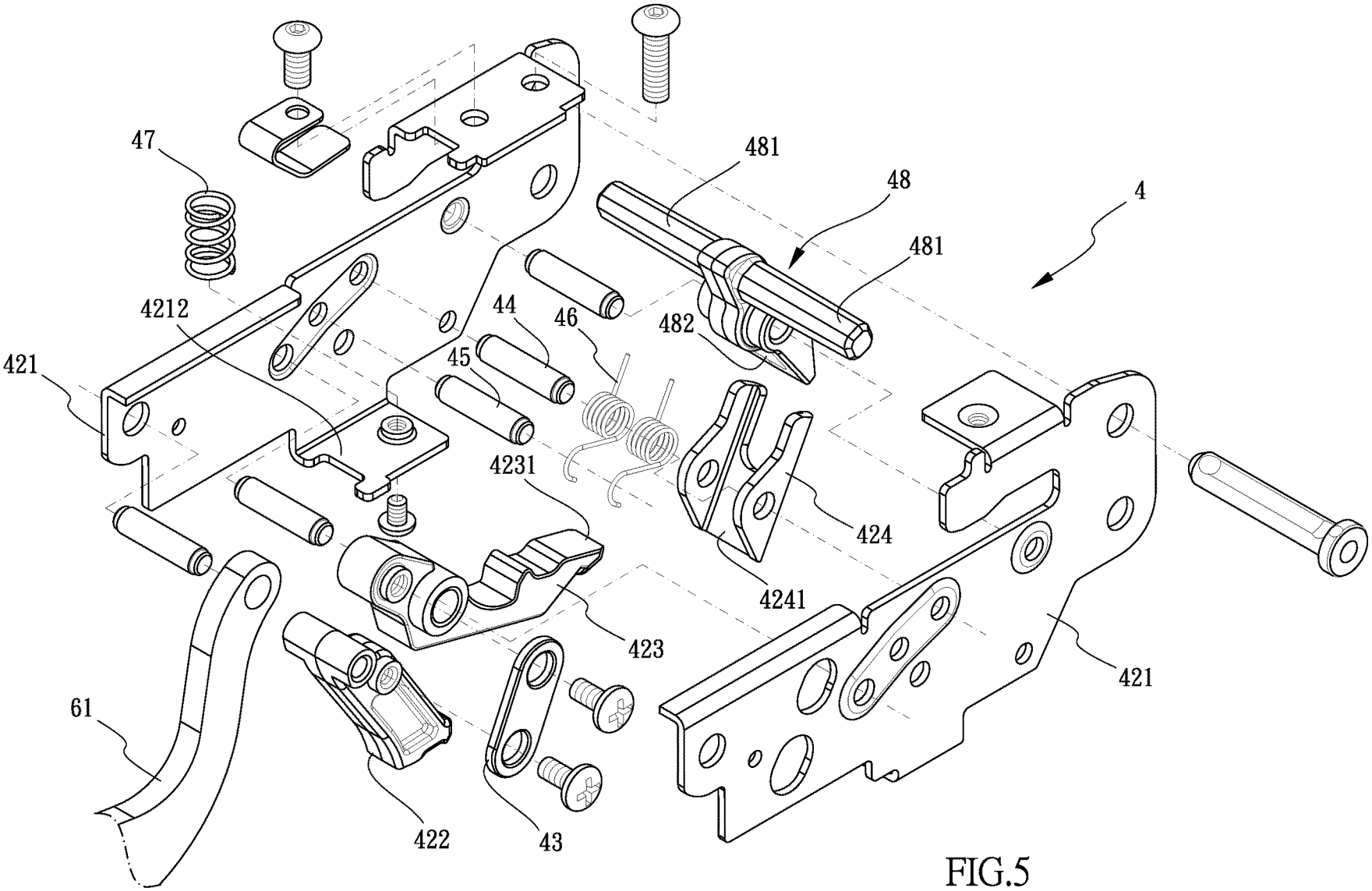
FIG. 5 is an exploded perspective schematic view of the details of the control component of the present disclosure.
Figure 6:
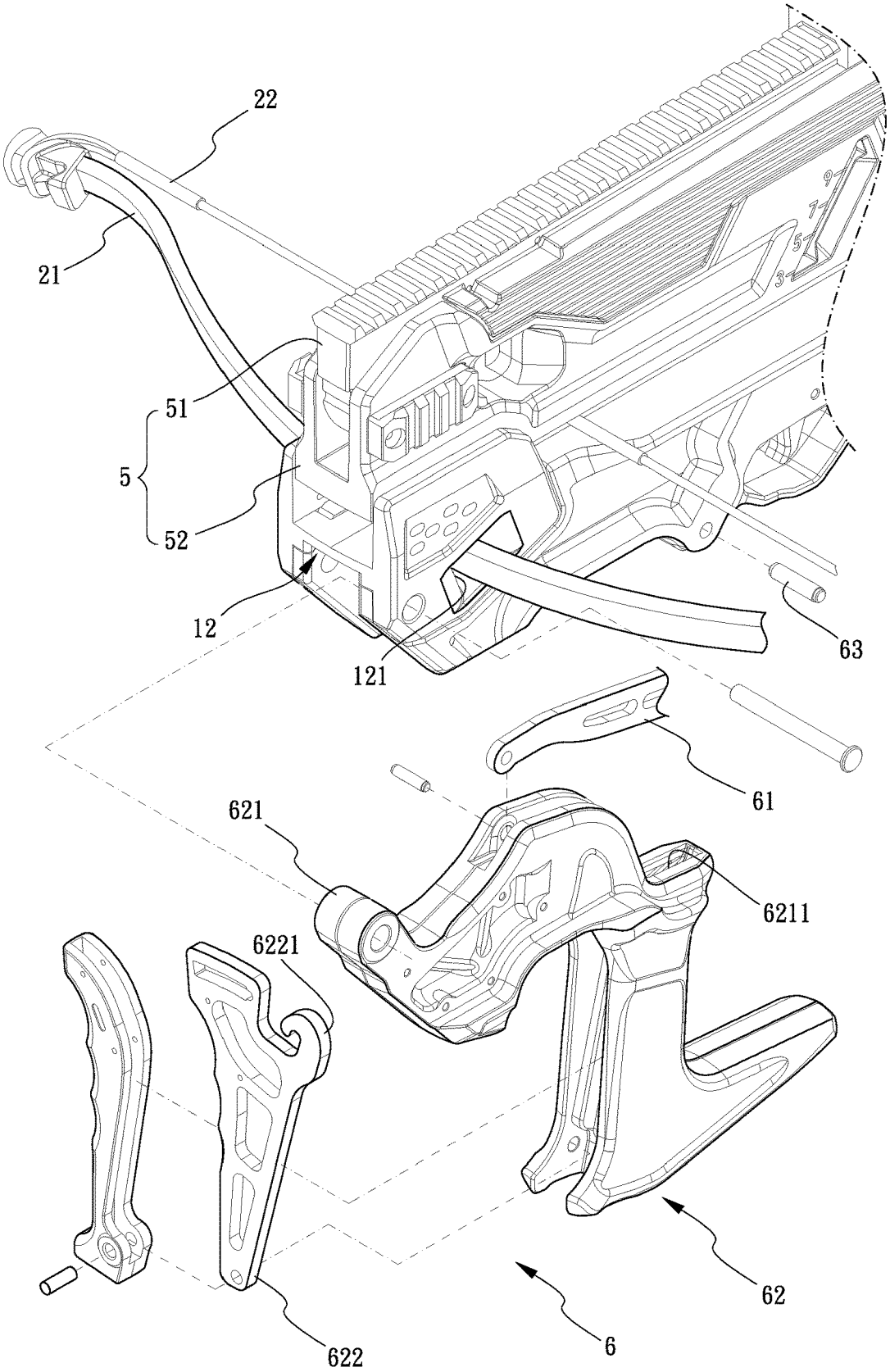
FIG. 6 is an exploded perspective schematic view of the main body and the control handle unit of the present disclosure.
Figure 7:
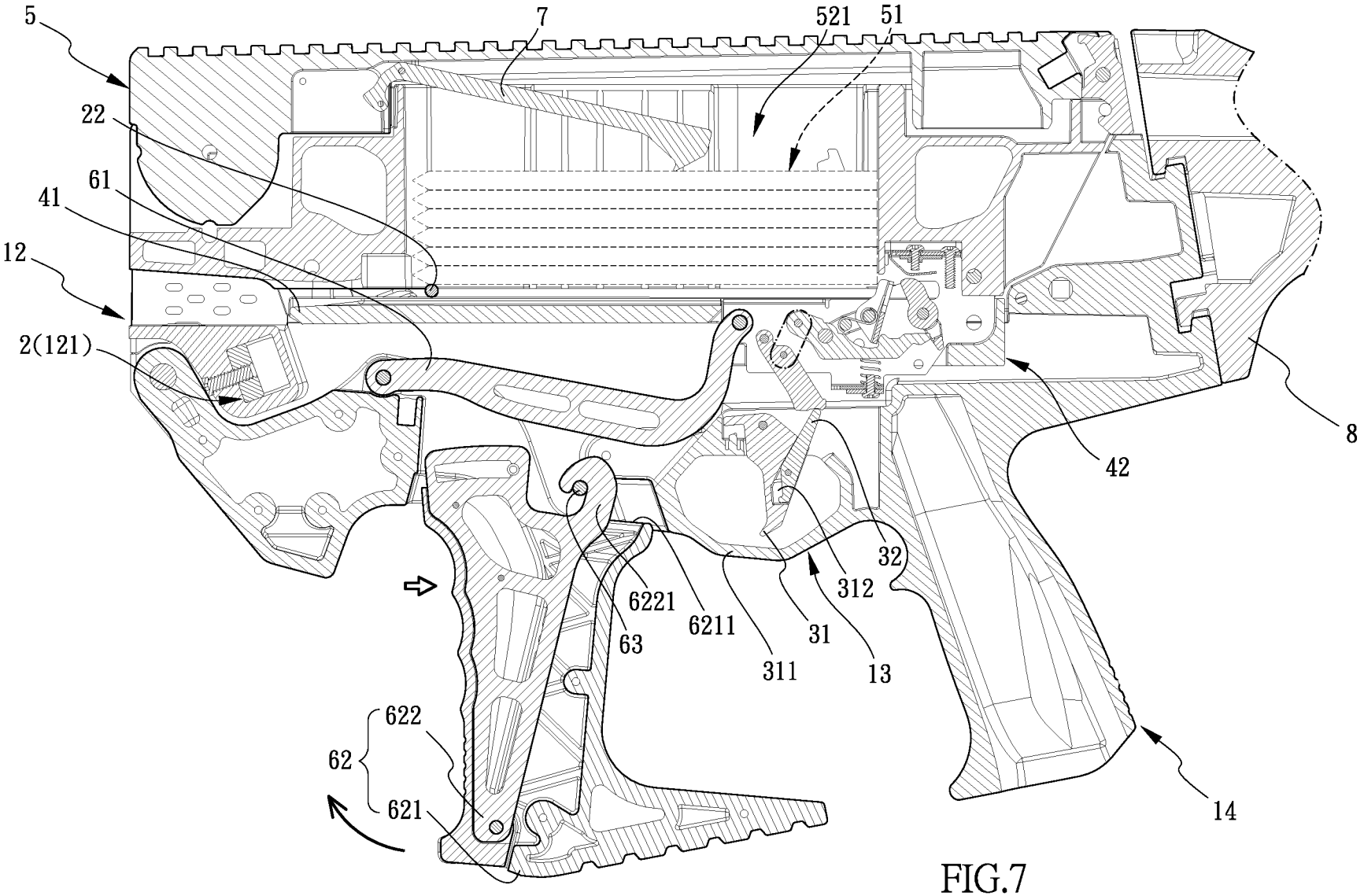
FIG. 7 is a sectional schematic view of lines VII-VII of FIG. 2.
Figure 7A:
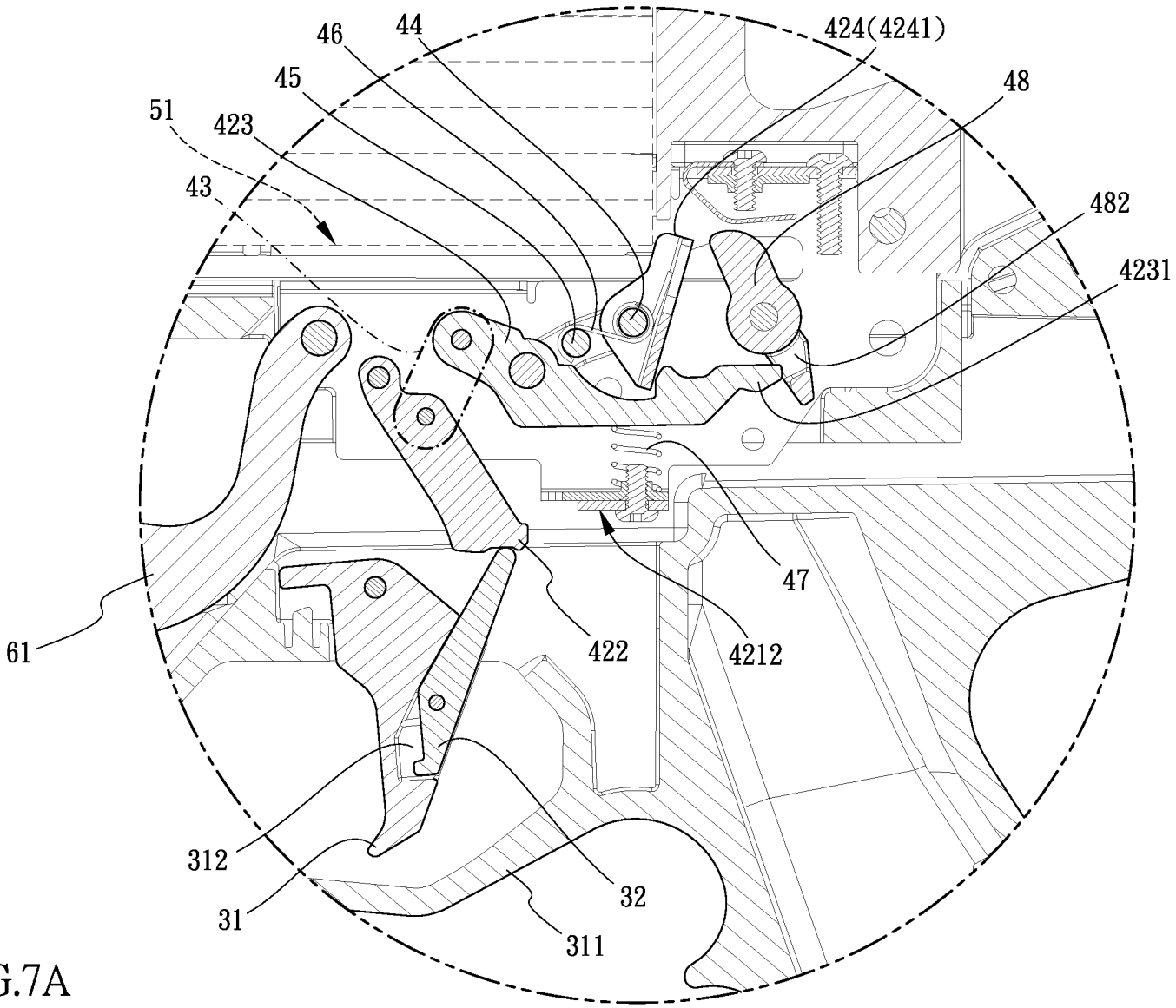
FIG. 7A is a partial enlarged schematic view of FIG. 7.

Firstly, as shown in FIGS. 4-6, in order to allow the control component 4 to drive the bowstring component 2 reliably and smoothly, the control component 4 further includes an arrow sliding base 41 and a brake unit 42. The arrow sliding base 41 is mounted on the arrow portion 11 and in a long shape, and has an installation port 411 corresponding to one end of the brake unit 42. The brake unit 42 is partially assembled on the installation port 411, and partially is pivotally assembled with the control handle unit 6. The trigger unit 3 is partially abutted against the brake unit 42 before the brake unit moves toward the shooting portion 12. Further, the arrow sliding base 41 is recessed with an arrow groove 412 corresponding to the arrow box 412, so that the plurality of arrows 51 fall into the arrow groove 412 one by one. When the user operates to change from the loading mode to the shooting mode, the arrow 51 will not completely fall into the arrow groove 412 but will be blocked by the bowstring component 2, until the shooting mode the arrow 51 will fall into the arrow groove 412. This structural design avoids the risk of a sudden trigger that causes the bowstring component 2 to operate releasing the arrow 51.

Figure 8:
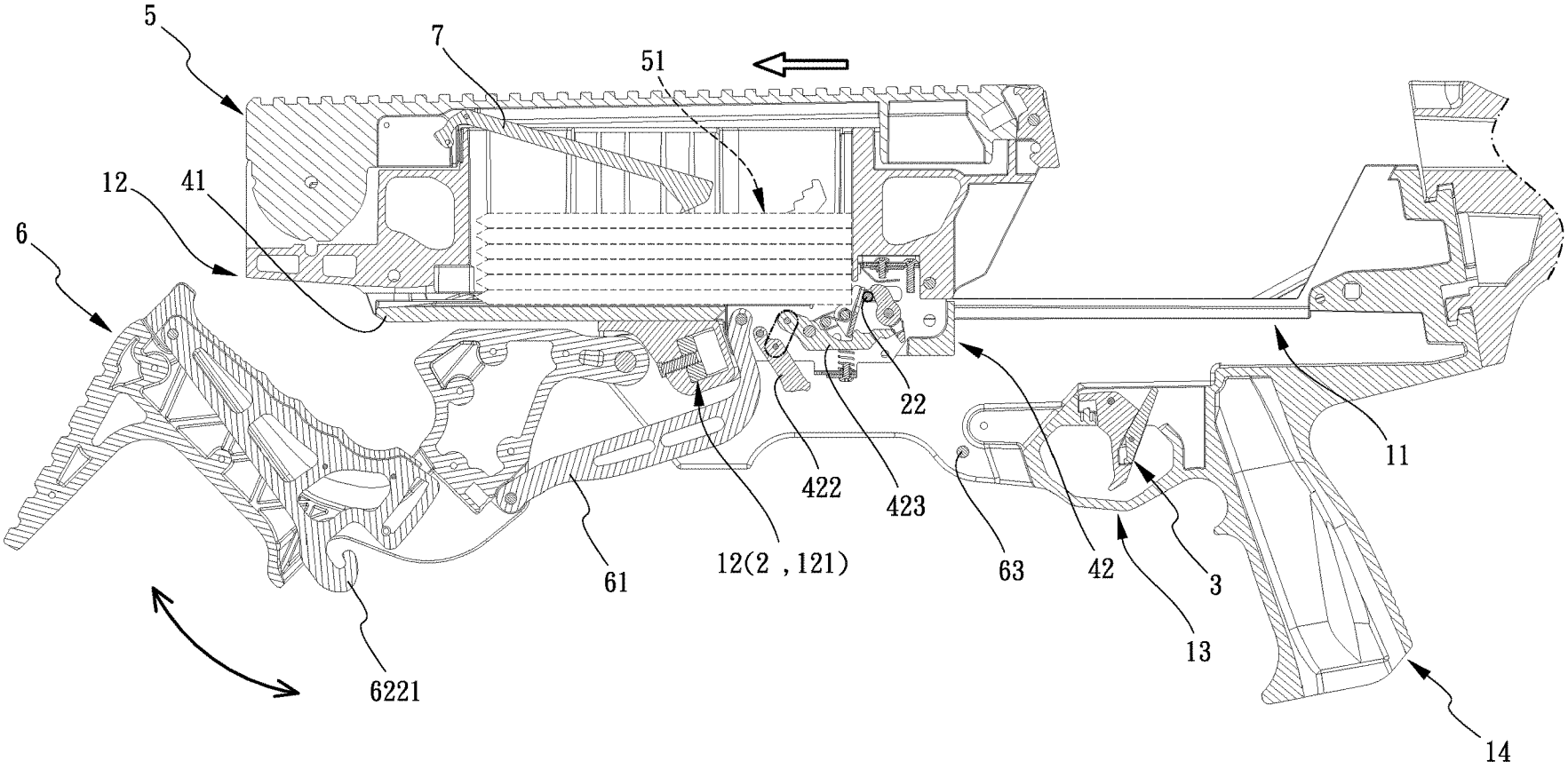
FIG. 8 is a schematic view of movement according to FIG. 7, the control handle unit pivotally moving toward the shooting portion, and the control component displaces toward the direction of the shooting portion.
Figure 9:
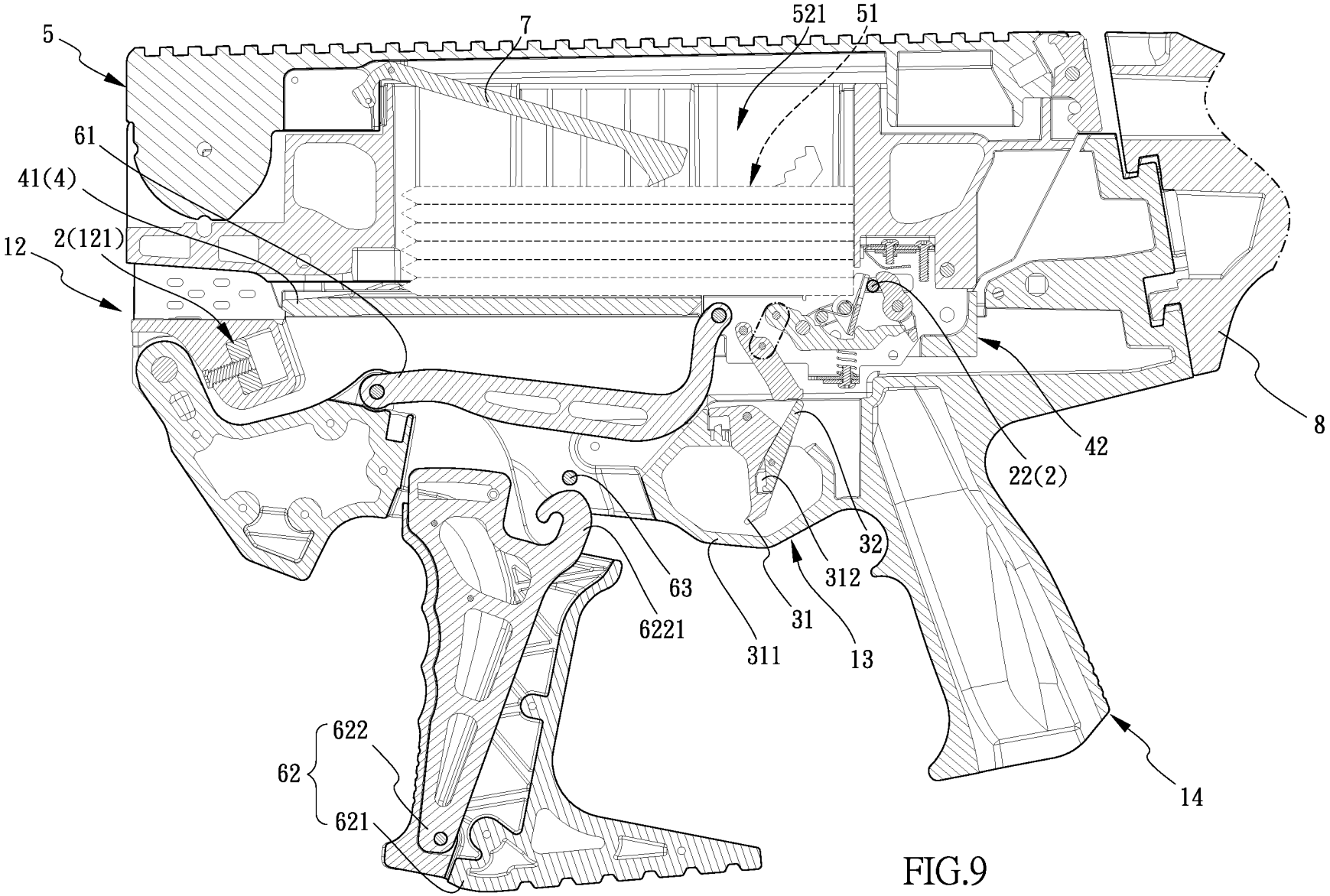
FIG. 9 is a schematic view of movement according to FIG. 8, after the control handle unit is pivoted back, the control component moves back and pulls the bow string in the bowstring component to stretch.
Figure 10:
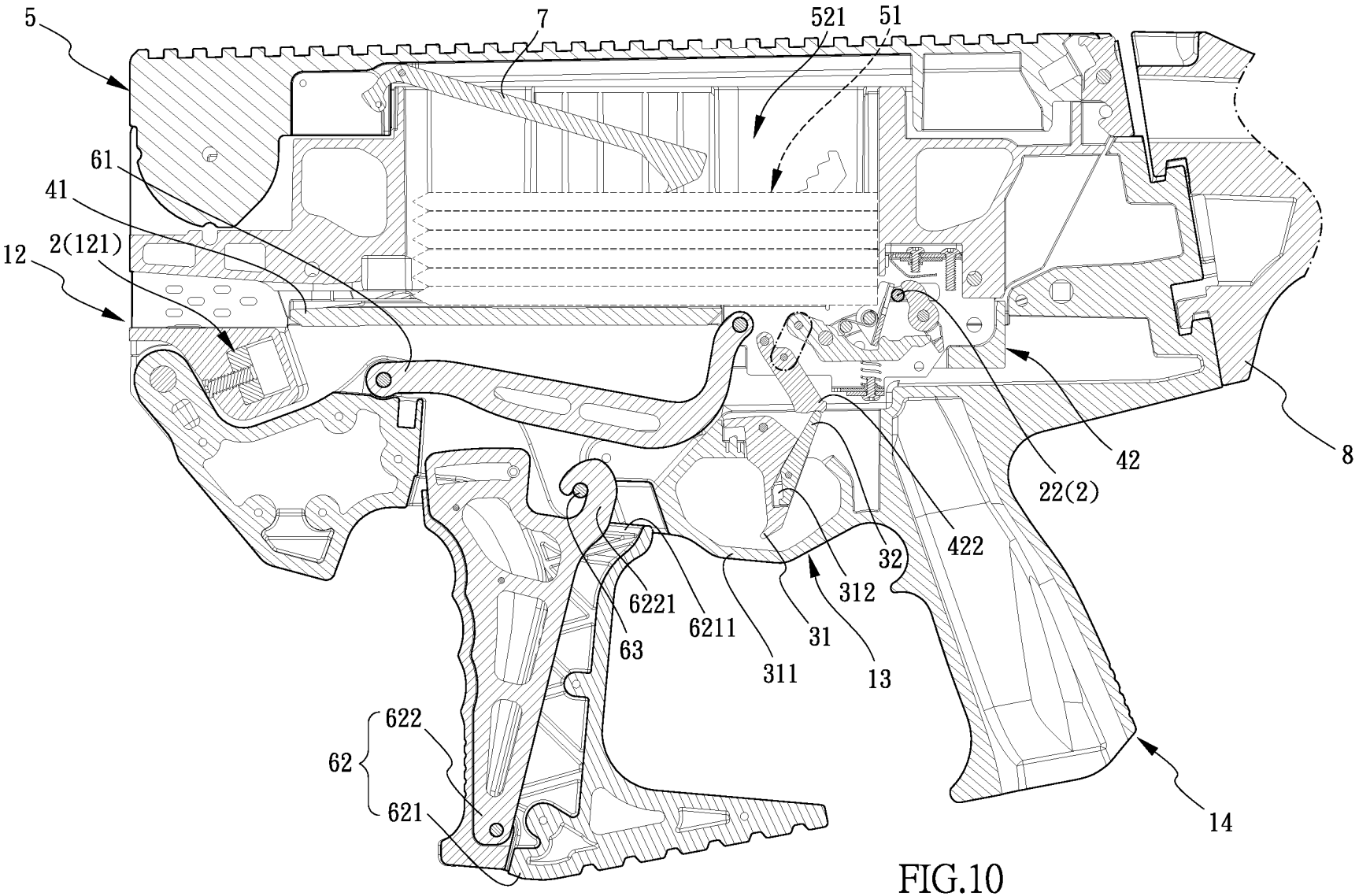
FIG. 10 is a schematic view of movement according to FIG. 9, after the control component returns to its original position, the lowest arrow among the plurality of arrows located in the arrow chamber falls into the arrow groove.
Figure 11:
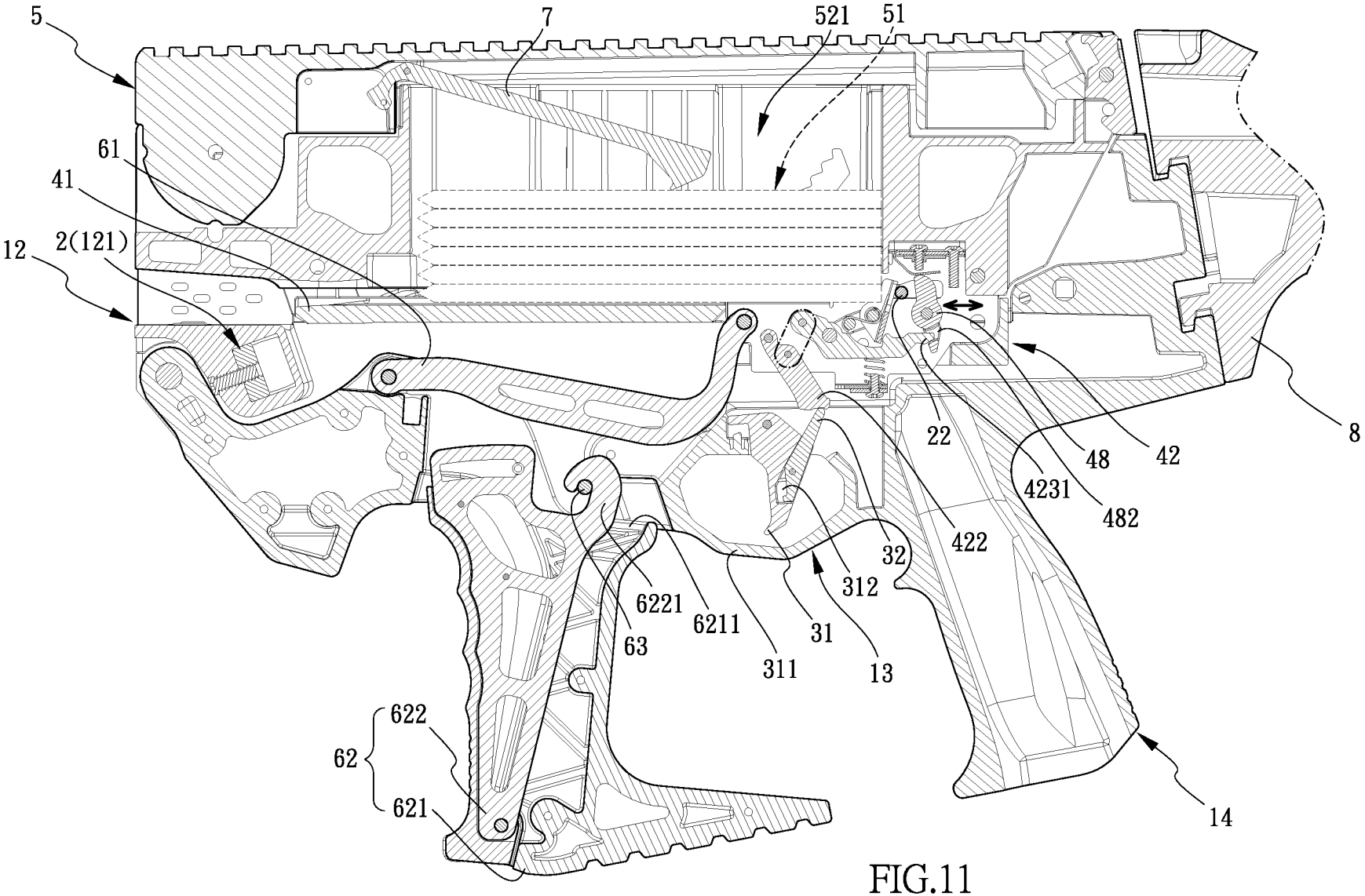
FIG. 11 is a sectional schematic view of switching the safety catch and limiting the trigger unit.
Figure 12:
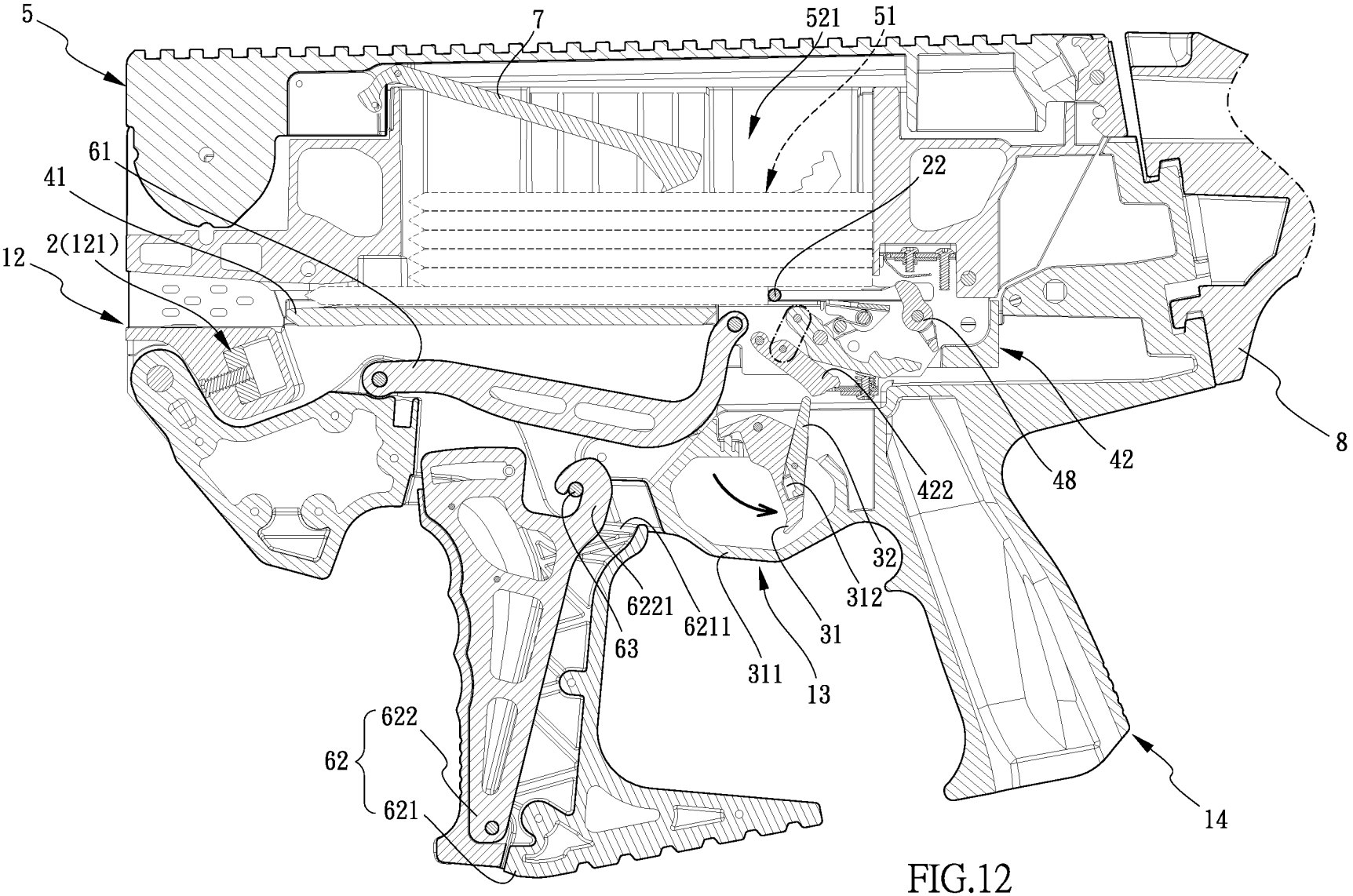
FIG. 12 is a schematic view of movement according to FIG. 10, press the trigger unit to shoot.
Figure 12A:
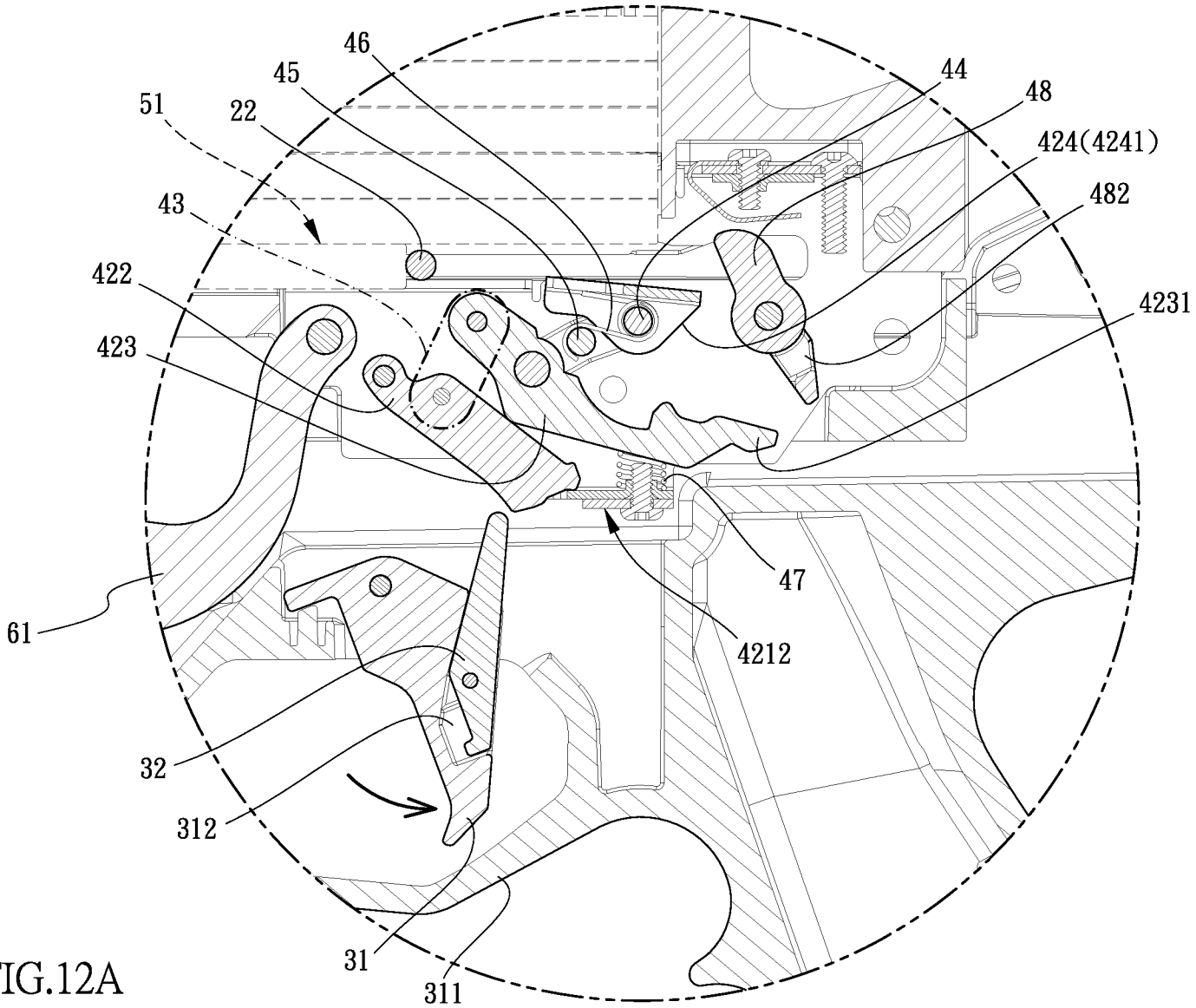
FIG. 12A is a partial enlarged schematic view of FIG. 12.

Moreover, the brake unit 42 of the present disclosure includes a housing 421 (formed by symmetrical (left and right) shells assembling together), a resisting block 422, a movable block 423, and a string buckle base 424. The housing 421 forms an accommodating space 4211 inside, one end of the resisting block 422 is pivotally assembled in the accommodating space 4211 and the other end of the resisting block 422 resists the trigger unit 3 during the shooting mode. The movable block 423 is pivotally disposed in the accommodating space 4211, and a linking piece 43 is fittingly engaged between the resisting block 422 and the movable block 423. Part of the string buckle base 424 is pivotally disposed in the accommodating space 4211 and the other part of the string buckle base 424 protrudes from the installation port 411 for movably restricting and releasing the bowstring component 2. The movable block 423 has a blocking portion 4231 corresponding to the string buckle base 424, and the blocking portion 4231 is movably abutted against the bottom of the string buckle base 424. The blocking portion 4231 of the movable block 423 can resist the string buckle base 424. The string buckle base 424 further includes a recessed slot 4241, and a shaft 44 penetrates the recessed slot 4241 of the string buckle base 424 and is pivotally assembled on the inner walls of both sides of the accommodating space 4211. An auxiliary axis 45 is pivotally assembled in the accommodating space 4211 and near the string buckle base 424. A torsion spring 26 is sleeved on the shaft 44, one end of the torsion spring 46 is hooked on the auxiliary axis 45, and the other end of the torsion spring 46 is elastically clamped on the groove wall of the recessed slot 4241. The torsion spring 46 elastically drives the string buckle base 424 return back. Through the torsion spring 46, when the user is operating the device during the loading mode, the string buckle base 424 will be pushed by the bowstring component 2 and moved forward first. After the bowstring component 2 exceeds the string buckle base 424, the string buckle base 424 will be elastically reset by the elastic force of the torsion spring 46. At this time, part of the bowstring component 2 will fall behind the string buckle base 424, and the blocking portion 4231 will engage the string buckle base 424 to prevent excessive movement from affecting the shooting of the bowstring component 2. At this time, the string loading is completed, and then the bowstring component 2 can be pulled back forward to shooting mode. Further, part of the control handle unit 6 is pivotally assembled inside the housing 421 and drives the brake unit 42 toward and away from the shooting portion 12. As shown in FIGS. 8, 9, and 10.

In addition to the above-mentioned torsion spring 46 providing the elastic reset function of the string buckle base 424, the movable block 423 that can limit the string buckle base 424 must also be controlled. The accommodating space 4211 has a positioning portion 4212 at the bottom of the accommodating space 4211. An elastic member 47 is provided between the positioning portion 4212 and the movable block 423, the two ends of the elastic member 47 are abutted against the bottom end of the movable block 423 and the positioning portion 4212, respectively. Further, the elastic member 47 abuts against the movable block 423 by elasticity, and allows the blocking portion 4231 abutting against the bottom of the string buckle base 424. So that it prevents the bowstring component 2 from ejecting arbitrarily when the trigger unit 3 is not pressed, reducing the risk of misfire, which can be found in FIGS. 8-10. In addition, in order to improve the safety of shooting, the accommodating space 4211 of the housing 421 further includes a safety catch 48, part of the safety catch 48 is pivotally assembled in the accommodating space 4211 and provided with a limiting hole 482, and the other part of the safety catch 48 protrudes from the installation port 411. Further, two push rods 481 respectively protrude/extend from both ends of the part of the safety catch 48 that protrudes from the installation port 411. The safety catch 48 pivots with the part that located in the accommodating space 4211 as the axis point. When the user controls the two push rods 481 that are near the string buckle base 424 under the shooting mode, the end of the safety catch 48 with the limiting hole 482 is away from the movable block 423, so that the movable block 423 can pivot, meanwhile the trigger unit 3 can be pressed to shoot. Conversely, when the two push rods 481 are away from the string buckle base 424 under the shooting mode, one end of the movable block 423 is inserted into the limiting hole 482 to limit pivot movement of the movable block 423, so that the trigger unit 3 is limited indirectly. In this way, it can be prevented from accidentally pulling the trigger unit 3 and releasing the arrow 51, thereby reliably avoiding the occurrence of danger, which can be found in FIG. 11 and FIG. 12.

As shown in FIGS. 5-10, the control handle unit 6 includes a linkage rod 61 and a control handle 62. In detail, one end of the control handle 62 is pivotally assembled at the shooting portion 12 of the main body 1, and the other end of the control handle 62 extends downward. Further, one end of the linkage rod 61 is pivotally assembled inside the control handle 62, and the other end of the linkage rod 61 is pivotally assembled on the control component 4. When the control handle 62 pivots toward the shooting portion 12, the linkage rod 61 is driven and moves the control component 4 simultaneously toward the shooting portion 12. On the contrary, when the control handle 62 pivots in the opposite direction to the shooting portion 12, the linkage rod 61 is driven and moves the controlled component 4 reset. The control handle 62 further includes an outer handle 621 and an inner handle 622. The side of the outer handle 621 facing the shooting portion 12 has a cutout 6211, and the inner handle 622 is pivotally assembled inside the outer handle 621 by one end of the inner handle 622, and part of the inner handle 622 is exposed outside the cutout 6211. Further, the top end of the inner handle 622 has a hook piece 6221 protruding and movable hooking on a positioning shaft 63 located in the main body 1. The pivot movement of the inner handle 622 relative to the outer handle 621 controls the hook piece 6221 hooking and releasing on the positioning shaft 63. With regard to the control handle unit 6, the user slightly moves the control handle 62 toward the direction to the grip portion 14, so that the hook piece 6221 disengages from the buckle between the positioning shaft 63. Further, the user presses the inner handle 622 to ensure that the hook piece 6221 is separated from the positioning shaft 63. After that, the user holds the control handle 62 and pivots the control handle 62 toward the shooting portion 12. During the pivot movement, through the linking rod 61, the control component 4 can be driven to move together simultaneously. In this way, the operation of the loading mode can be completed, and the string buckle base 424 can reliably control the bowstring component 2 to pull and accumulate force.

Further, for the arrow box 5, the present disclosure mainly provides continuous shooting of multiple arrows 51, so that the arrow box 5 provides the use of continuous releasing. The arrow box 5 includes a bottom box member 52 and a movable box sealing member 53. The bottom box member 52 is assembled in the arrow portion 11 and the shooting portion 12 of the main body 1, and an arrow chamber 521 is recessed on the top surface of the bottom box member 52 corresponding to the arrow portion 11, and a pivot groove 522 is cut through the bottom box member 52 corresponding to the shooting portion 12. Moreover, one end of the movable box sealing member 53 is pivotally assembled in the pivot groove 522, and the other end of the movable box sealing member 53 movably pivots toward and away from the arrow chamber 521. The bottom box member 52 has a spring pressing member 7 at the opening of the arrow chamber 521. One end of the spring pressing member 7 is assembled at the opening of the arrow chamber 521, and the other end of the spring pressing member 7 extends obliquely toward the inside of the arrow chamber 521 and abuts against the uppermost arrow 51 among the plurality of arrows 51. Therefore, every time the control handle unit 6 drives the displacement and reset of the control component 4, the arrow 51 located at the bottom is set by the pressing member 7 to fall into the arrow groove 412 and wait for release. The detailed figures can be found in FIGS. 1-5.

Figure 13:
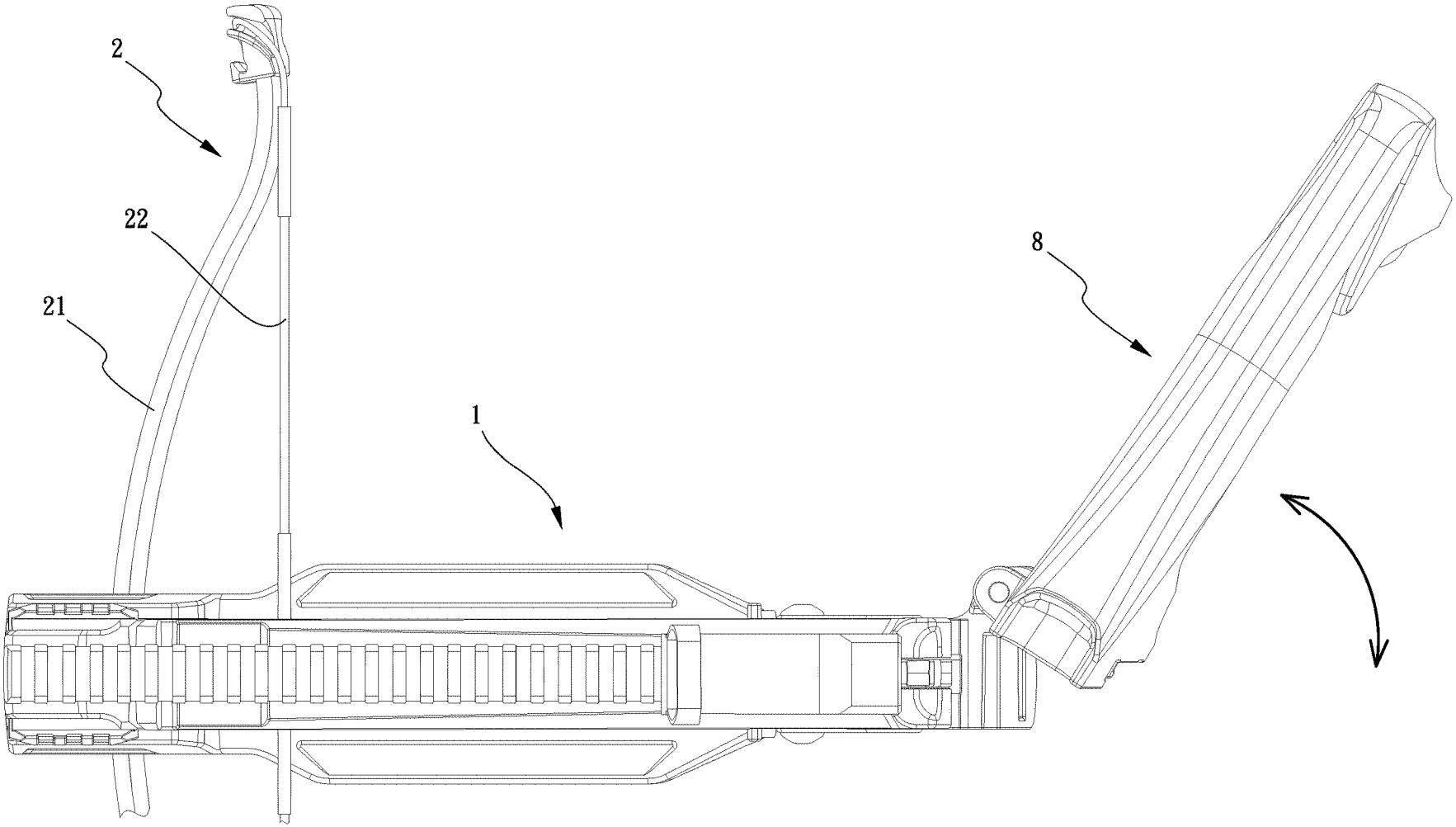
FIG. 13 is a planar schematic top view of the folding bracket member folding and swinging.

The main body 1 further includes a folding bracket member 8 at one end opposite to the shooting portion 12. In detail, one end of the folding bracket member 8 is pivotally connected to the main body 1, and the folding bracket member 8 can be kept next to one side of the main body 1 as a keeping mode. Further, the folding bracket member 8 can be pivoted to be coaxial with the main body 1 to increase the overall length of the rapid repeating device, so that the other end of the folding bracket member 8 can be abutted against the shoulder socket to stabilize the shooting, as shown in FIG. 13. the trigger unit 3 includes a trigger piece 31 and a long-push block 32. The trigger piece 31 is pivotally assembled in a protective bow 311 of the trigger portion 13, and the inner end surface of the trigger piece 31 is cut to form a slot 312. In detail, one part of the long-push block 32 is inserted into the slot 312, and the other end of the long-push block 32 extends toward the direction of the control component 4 and protrudes from the slot 312. The protruding part of the long-push block 32 blocks the control component 4 when the control component 4 is displaced toward the direction of the shooting portion 12 and resets. Therefore, the resisting block 422 of the control component 4 is pushed by the long-push block 32 and controlled by the trigger piece 31, and the bowstring component 2 is indirectly limited and released by the string buckle seat 424. As shown in FIG. 5.

The bowstring component 2 further includes a bow arm 21 and a bow string 22. An assembly hole 121 is longitudinally provided in the shooting portion 12, and the bow string 22 is tied to both ends of the bow arm 21. Further, the bow arm 21 passes through the assembly hole 2 and is limited in the assembly hole 121 with a middle section, and the bow string 21 in a curved shape, and is located at the space formed between the arrow portion 11 and the arrow box 5. In conjunction with the aforementioned actions, the pivot movement of the control handle unit 6 can indirectly control the string buckle base 424 to move toward the shooting portion 12 and hook the bow string 22 away from the shooting portion 12, so that the bow string 424 will be tightened. After the arrow 51 falls to the arrow groove 412, by pressing the trigger unit 3, the movable block 423 can be controlled to move toward the direction of the shooting portion 12 through the tight elasticity of stretching the bow string 22. Without restricting the string buckle base 424, the bow string 22 can release the arrow 51 to shoot. During the whole process, the trigger unit 3 is located in the protective bow 311 and does not move. Therefore, the user can keep the fingers inside the protective bow 311 to continuously operate the trigger unit 3. Unlike the problem of hand pinching in conventional technology, the present disclosure can maintain continuous shooting and stability and accuracy.

What is claimed is:

1. A rapid repeating device, comprising:

a main body, having an arrow portion on the top, a shooting portion equipped with a bowstring component, and a trigger portion at the bottom and provided with a trigger unit;

a control component, disposed on the arrow portion of the main body, and partially located inside the main body and partially exposed outside the arrow portion; wherein when the control component moves toward the shooting portion, the control component is away from the trigger unit, and when the control component moves away from the shooting portion, the control component movably abuts against the trigger unit;

an arrow box, disposed on the top of the main body; wherein a plurality of arrows are disposed in the arrow box and one by one fall into the control component that is partially exposed outside the arrow portion; and a control handle unit, having one end pivotally disposed on the main body and located below the arrow portion; wherein, the control handle unit is pivotally assembled with the control component, wherein a loading mode is formed when the control handle unit is pivoted relative to the main body and moves the control component toward the shooting portion; wherein a shooting mode is formed when the control handle unit is pivoted to the direction opposite to the shooting portion and moves the control component back;

an arrow sliding base mounted on the arrow portion, and having an installation port corresponding to one end of a brake unit; wherein the brake unit is partially assembled on the installation port, and the control handle unit is partially assembled to the brake unit; wherein the brake unit is partially abutted against the trigger unit before the brake unit moves toward the shooting portion; wherein the arrow sliding base is recessed with an arrow groove corresponding to the arrow box, so that the plurality of arrows fall into the arrow groove one by one;

the brake unit includes a housing, a resisting block, a movable block and a string buckle base; wherein the housing forms an accommodating space inside, one end of the resisting block is pivotally assembled in the accommodating space and the other end of the resisting block resists the trigger unit during the shooting mode; wherein the movable block is pivotally disposed in the accommodating space, and a linking piece is fittingly engaged between the resisting block and the movable block; wherein part of the string buckle base is pivotally disposed in the accommodating space and the other part of the string buckle base protrudes from the installation port and movably restrict and release the bowstring component; wherein the movable block has a blocking portion corresponding to the string buckle base, and the blocking portion is movably abutted against the bottom of the string buckle base;

the accommodating space of the housing includes a safety catch, part of the safety catch pivotally assembled in the accommodating space and provided with a limiting hole, and the other part of the safety catch protruding from the installation port; wherein two push rods respectively protrudes/extends from both ends of the part of the safety catch that protrudes from the installation port; wherein the safety catch pivots with the part that located in the accommodating space as the axis point; wherein when the two push rods are near the string buckle base, the end of the safety catch with the limiting hole is away from the movable block, so that the movable block pivots; wherein when the two push rods are away from the string buckle base, one end of the movable block is inserted into the limiting hole to limit pivot movement of the movable block, so that the trigger unit is limited indirectly;

wherein through each pivot movement of the control handle unit, the displacement of the control component on the arrow portion is controlled; wherein during the loading mode, the control component does not abut against the trigger unit, and the trigger unit retains the trigger portion; wherein during the shooting mode, the control component moves in the direction opposite to the shooting portion, the control component abuts against the trigger unit, so that it allows the pulling of the trigger unit to drive the control component and release the bowstring component to release the plurality of arrows one by one.

2. The rapid repeating device according to claim 1, wherein the accommodating space has a positioning portion at the bottom of the accommodating space; wherein an elastic member is provided between the positioning portion and the movable block, the two ends of the elastic member are abutted against the bottom end of the movable block and the positioning portion respectively; wherein the elastic member abuts against the movable block by elasticity, and allows the blocking portion abutting against the bottom of the string buckle base.

3. The rapid repeating device according to claim 1, wherein the string buckle base further includes a recessed slot, and a shaft penetrates the recessed slot of the string buckle base and is pivotally assembled on the inner walls of both sides of the accommodating space; wherein an auxiliary axis is pivotally assembled in the accommodating space and near the string buckle base; wherein a torsion spring is sleeved on the shaft, one end of the torsion spring is hooked on the auxiliary axis, and the other end of the torsion spring is elastically clamped on the groove wall of the recessed slot; wherein the torsion spring elastically drives the string buckle base return back, and part of the control handle unit is pivotally assembled inside the housing and drives the brake unit toward and away from the shooting portion.

4. The rapid repeating device according to claim 1, wherein the control handle unit includes a linkage rod and a control handle; wherein one end of the control handle is pivotally assembled at the shooting portion of the main body, and the other end of the control handle extends downward; wherein one end of the linkage rod is pivotally assembled inside the control handle, and the other end of the linkage rod is pivotally assembled on the controlled component; wherein when the control handle pivots toward the shooting portion, the linkage rod drives the controlled component simultaneously toward the shooting portion;

wherein when the control handle pivots in the opposite direction to the shooting portion, the linkage rod drives the controlled component reset.

5. The rapid repeating device according to claim 4, wherein the control handle further includes an outer handle and an inner handle; wherein the side of the outer handle facing the shooting portion has a cutout, and the inner handle is pivotally assembled inside the outer handle by one end of the inner handle, and part of the inner handle is exposed outside the cutout; wherein the top end of the inner handle has a hook piece protruding and movable hooking on a positioning shaft located in the main body; wherein the pivot movement of the inner handle relative to the outer handle controls the hook piece hooking and releasing on the positioning shaft.

6. The rapid repeating device according to claim 1, wherein the arrow box includes a bottom box member and a movable box sealing member; wherein the bottom box member is assembled in the arrow portion and the shooting portion of the main body, and an arrow chamber is recessed on the top surface of the bottom box member corresponding to the arrow portion, and a pivot groove is cut through the bottom box member corresponding to the shooting portion; wherein one end of the movable box sealing part is pivotally assembled in the pivot groove, and the other end of the movable box sealing member movable movably pivots toward and away from the arrow chamber; wherein the bottom box member has a spring pressing member at the opening of the arrow chamber; wherein one end of the spring pressing member is assembled at the opening of the arrow chamber, and the other end of the spring pressing member extends obliquely toward the inside of the arrow chamber and abuts against the uppermost arrow among the plurality of arrows.

7. The rapid repeating device according to claim 1, wherein the main body further includes a folding bracket member at one end opposite to the shooting portion; wherein one end of the folding bracket member is pivotally connected to the main body, and the folding bracket member can be kept next to one side of the main body as a keeping mode; wherein the folding bracket member can be pivoted to be coaxial with the main body to increase the overall length of the rapid repeating device, so that the other end of the folding bracket member can be abutted against the shoulder socket to stabilize the shooting.

8. The rapid repeating device according to claim 1, wherein the trigger unit includes a trigger piece and a long-push block; wherein the trigger piece is pivotally assembled in a protective bow of the trigger portion, and the inner end surface of the trigger piece is cut to form a slot; wherein one part of the long-push block is inserted into the slot, and the other end of the long-push block extends toward the direction of the control component and protrudes from the slot; wherein the protruding part of the long-push block blocks the control component when the control component is displaced toward the direction of the shooting portion and resets.

9. The rapid repeating device according to claim 1, wherein the bowstring component further includes a bow arm and a bow string; wherein an assembly hole is longitudinally provided in the shooting portion, and the bow string is tied to both ends of the bow arm; wherein the bow arm passes through the assembly hole and is limited in the assembly hole with a middle section, and the bow string is located at the space formed between the arrow portion and the arrow box.

10. A rapid repeating device, comprising:

a main body, having an arrow portion on the top, a shooting portion equipped with a bowstring component, and a trigger portion at the bottom and provided with a trigger unit;

a control component, disposed on the arrow portion of the main body, and partially located inside the main body and partially exposed outside the arrow portion; wherein when the control component moves toward the shooting portion, the control component is away from the trigger unit, and when the control component moves away from the shooting portion, the control component movably abuts against the trigger unit;

the trigger unit including a trigger piece and a long-push block; wherein the trigger piece is pivotally assembled in a protective bow of the trigger portion, and the inner end surface of the trigger piece is cut to form a slot; wherein one part of the long-push block is inserted into the slot, and the other end of the long-push block extends toward the direction of the control component and protrudes from the slot; wherein the protruding part of the long-push blocks the control component when the control component is displaced toward the direction of the shooting portion and resets;

an arrow box, disposed on the top of the main body; wherein a plurality of arrows are disposed in the arrow box and one by one fall into the control component that is partially exposed outside the arrow portion;

a control handle unit, having one end pivotally disposed on the main body and located below the arrow portion; wherein, the control handle unit is pivotally assembled with the control component; wherein a loading mode is formed when the control handle unit is pivoted relative to the main body and moves the control component toward the shooting portion; wherein a shooting mode is formed when the control handle unit is pivoted to the direction opposite to the shooting portion and moves the control component back; and wherein through each pivot movement of the control handle unit, the displacement of the control component on the arrow portion is controlled; wherein during the loading mode, the control component does not abut against the trigger unit, and the trigger unit retains the trigger portion; wherein during the shooting mode, the control component moves in the direction opposite to the shooting portion, the control component abuts against the trigger unit, so that it allows the pulling of the trigger unit to drive the control component and release the bowstring component to release the plurality of arrows one by one.

* * * * *